US009758969B2

(12) United States Patent
Tenute

(10) Patent No.: US 9,758,969 B2
(45) Date of Patent: Sep. 12, 2017

(54) ROOFING SYSTEM

(71) Applicant: GUTTER CAP, INC., Naperville, IL (US)

(72) Inventor: Steven J. Tenute, Naperville, IL (US)

(73) Assignee: Gutter Cap, Inc., Naperville, IL (US)

( * ) Notice: Subject to any disclaimer, the term of this patent is extended or adjusted under 35 U.S.C. 154(b) by 0 days.

(21) Appl. No.: 14/962,164

(22) Filed: Dec. 8, 2015

(65) Prior Publication Data

US 2016/0194878 A1 Jul. 7, 2016

Related U.S. Application Data

(60) Provisional application No. 62/100,193, filed on Jan. 6, 2015.

(51) Int. Cl.

| | |
|---|---|
| ***E04D 1/18*** | (2006.01) |
| ***E04D 1/20*** | (2006.01) |
| *E04D 1/00* | (2006.01) |

(52) U.S. Cl.

CPC ..... *E04D 1/18* (2013.01); *E04D 1/20* (2013.01); *E04D 2001/005* (2013.01)

(58) Field of Classification Search

CPC ..... E04D 1/18; E04D 1/265; E04D 2001/005; E04F 13/0864; E04F 13/185; E04F 13/12

USPC ..... 52/518, 519, 525, 535

See application file for complete search history.

(56) References Cited

U.S. PATENT DOCUMENTS

| | | | | | |
|---|---|---|---|---|---|
| 2,811,118 | A * | 10/1957 | Ball | E04D 1/18 | 52/518 |
| 4,593,512 | A * | 6/1986 | Funaki | E04F 13/0864 | 52/519 |
| 5,347,784 | A * | 9/1994 | Crick | E04F 13/185 | 52/314 |
| 6,029,415 | A * | 2/2000 | Culpepper | E04F 13/0864 | 52/522 |
| 6,224,701 | B1 * | 5/2001 | Bryant | E04F 13/0864 | 156/227 |
| 6,715,250 | B2 * | 4/2004 | Bryant | E04F 13/0864 | 52/522 |
| 7,240,461 | B1 * | 7/2007 | Vandeman | E04F 13/0864 | 52/314 |
| D622,420 | S * | 8/2010 | King | E04F 13/185 | D25/151 |
| D643,133 | S * | 8/2011 | Steffes | E04F 13/185 | D25/141 |
| 8,381,472 | B1 * | 2/2013 | Fleenor | E04F 13/0825 | 52/459 |
| 2004/0148884 | A1 * | 8/2004 | Jacques | E04D 1/265 | 52/302.1 |
| 2004/0159062 | A1 * | 8/2004 | Donlin | E04F 13/18 | 52/506.01 |

(Continued)

*Primary Examiner* — Joshua J Michener
*Assistant Examiner* — Alp Akbasli
(74) *Attorney, Agent, or Firm* — Barnes & Thornburg LLP

(57) ABSTRACT

A roofing system includes shingles having a front surface, a rear surface, an upper portion, and a lower portion. The lower portion is wider than the upper portion. A tongue extends from the upper portion and overlaps the lower portion, thereby defining a first groove between the tongue and the front surface of the lower portion. A return extends from an end of the lower portion opposite the upper portion, thereby defining a second groove between the return portion and the rear surface of the lower portion.

15 Claims, 4 Drawing Sheets

(56) References Cited

U.S. PATENT DOCUMENTS

| | | | | |
|---|---|---|---|---|
| 2005/0102946 | A1* | 5/2005 | Stucky | E04F 13/0864 52/518 |
| 2005/0210806 | A1* | 9/2005 | Guerra | B32B 11/08 52/518 |
| 2007/0107356 | A1* | 5/2007 | Steffes | E04F 13/0864 52/518 |
| 2007/0144095 | A1* | 6/2007 | King | E04D 1/265 52/518 |
| 2007/0193177 | A1* | 8/2007 | Wilson | E04F 13/0864 52/518 |
| 2009/0038252 | A1* | 2/2009 | King | E04F 13/185 52/506.05 |
| 2010/0236175 | A1* | 9/2010 | King | B05B 13/0207 52/314 |

* cited by examiner

ROOFING SYSTEM

CROSS-REFERENCE TO RELATED APPLICATIONS

This application claims benefit of U.S. Provisional Patent Application No. 62/100,193, filed Jan. 6, 2015, and incorporates by reference the disclosure thereof in its entirety.

BACKGROUND AND SUMMARY OF THE DISCLOSURE

Known roofing systems typically comprise substantially planar shingles made of asphalt, slate, cedar, among other materials, laid onto a roofing substrate, for example, plywood, in an overlapping manner. Roofing systems using such shingles may provide an aesthetic appearance, but they have limited longevity. Asphalt and cedar shingles can dry out and crack, creating potential leakage paths for water that may fall on the roof. Slate shingles may be more resilient in some ways, but may be less resistant to impact damage. They also are very costly.

Some known roofing systems comprise metal shingles. Roofs comprising metal shingle may have longer lives than roofs comprising asphalt, slate or cedar shingles. Such roofs, however, typically are less aesthetic than roofs comprising asphalt, slate or cedar shingles. Also, the exposed, visible surfaces of metal shingles can rust, making them even less aesthetic.

DETAILED DESCRIPTION OF THE DRAWINGS

Figures 1, 8:
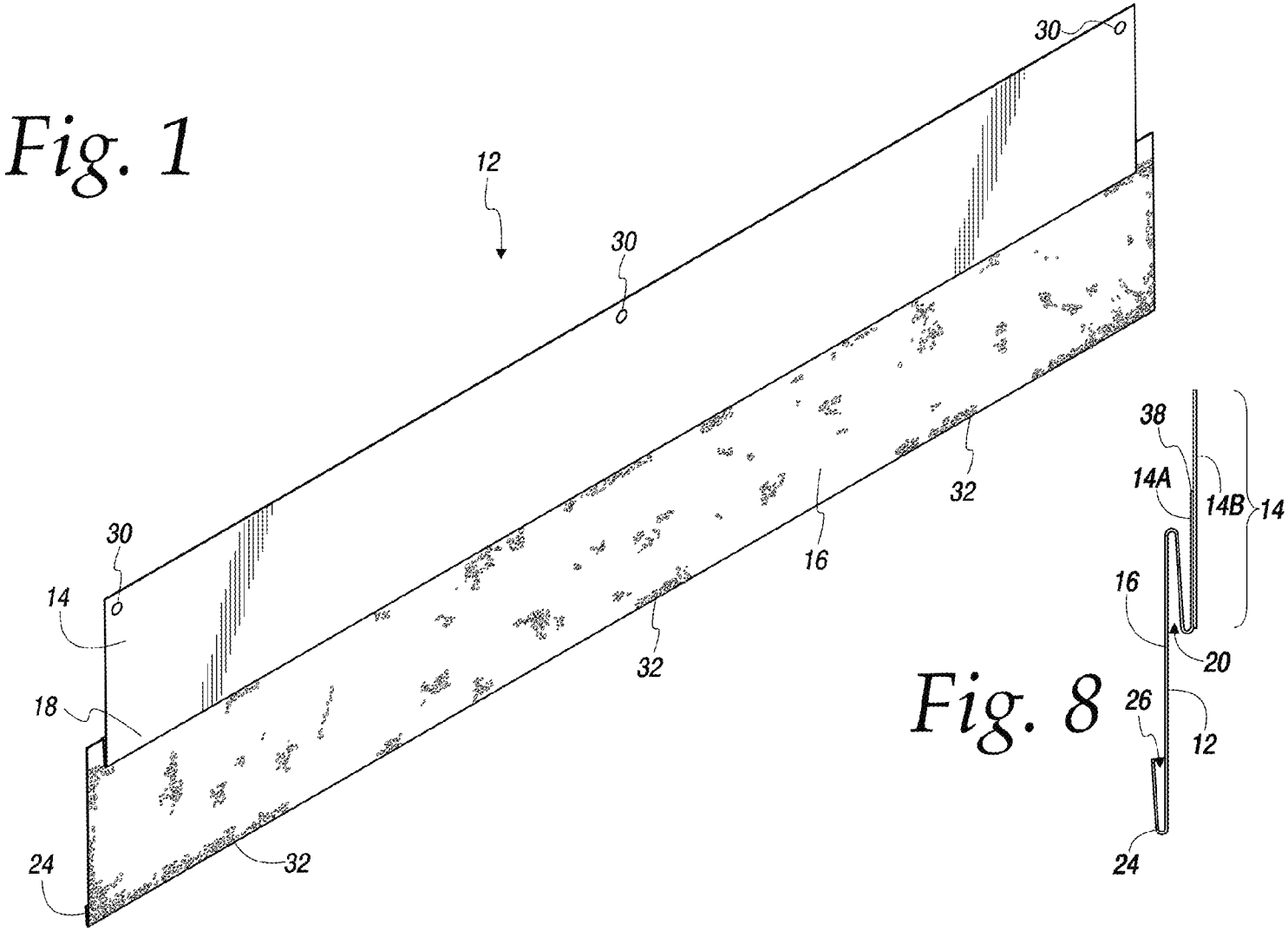
FIG. 1 is a front perspective view of an illustrative roofing shingle according to the present disclosure.
FIG. 8 is a perspective view of another illustrative roofing shingle according to the present disclosure.
Figure 2:
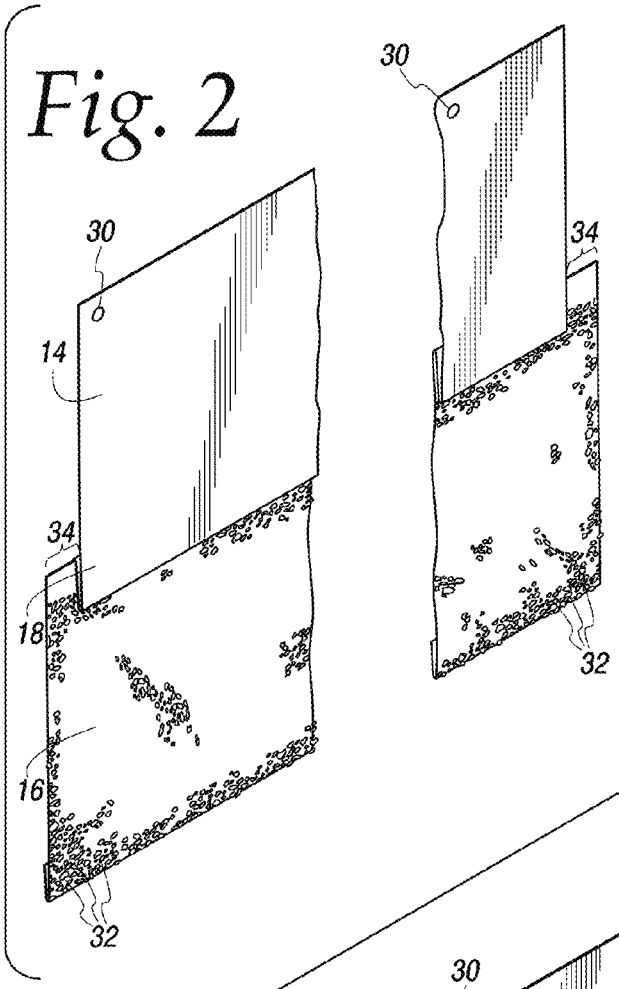
FIG. 2 is another front perspective view of the roofing shingle of FIG. 1.
Figure 3:
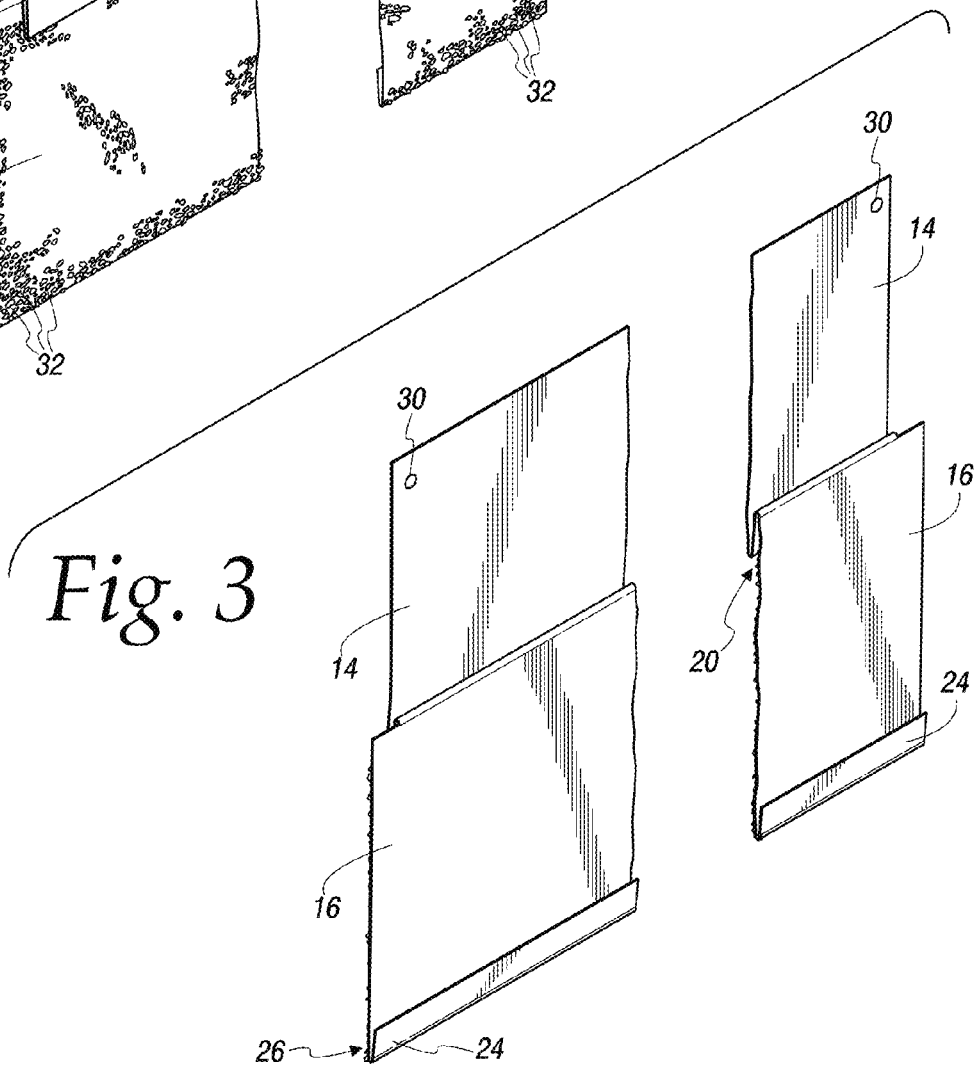
FIG. 3 is a rear perspective view of the roofing shingle of FIG. 1.
Figure 4:
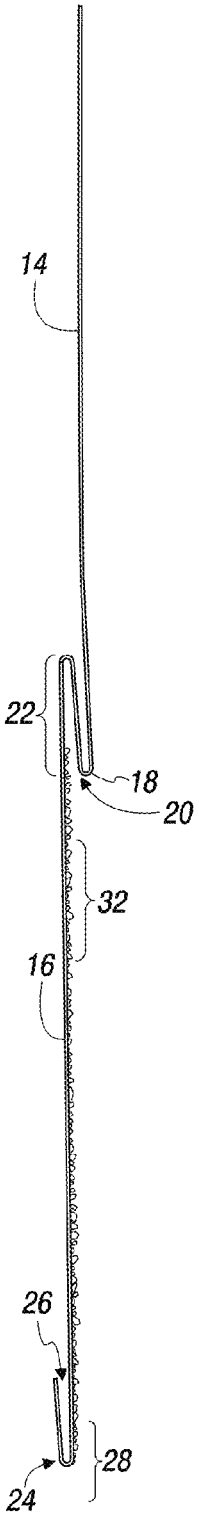
FIG. 4 is a side elevation view of the roofing shingle of FIG. 1.

Terms of direction and orientation, for example, upward, upper, downward, lower, and the like, are used herein to describe relative orientation of components, and should not be construed in an absolute sense unless context dictates otherwise.

The drawings show an illustrative roofing system 10 comprising a plurality of illustrative roofing shingles 12. Each shingle 12 is shown as having an upper (or first) portion 14 and a lower (or second) portion 16. The upper portion 14 has a first (or free) end opposite the lower portion 16 and a second end adjacent the lower portion. The lower portion 16 has a first (or free) end opposite the upper portion 14 and a second end adjacent the upper portion.

A tongue 18 extends downwardly from the upper portion 14 and overlaps at least part of the lower portion 16. The tongue 18 and the lower portion 16 cooperate to define an upper (or first) groove 20 there between. In the illustrated embodiment(s), the upper tongue 18 and upper groove 20 are defined by a Z-shaped fold 22. In other embodiments, the tongue 18 and upper groove 20 may be defined in other ways.

As illustrated, a return (or third portion) 24 extends toward the upper portion 14 from the free end of the lower portion 16. In other embodiments, the return 24 could extend from the lower portion 16 intermediate the first and second ends thereof. The return 24 and the lower portion 16 cooperate to define a lower (or second) groove 26 there between. In the illustrated embodiment(s), the return 24 and the lower groove 26 are defined by a U-shaped fold 28 at the free end of the lower portion 16. In other embodiments, the return 24 and the lower groove 26 could be defined in other ways.

Figure 7:
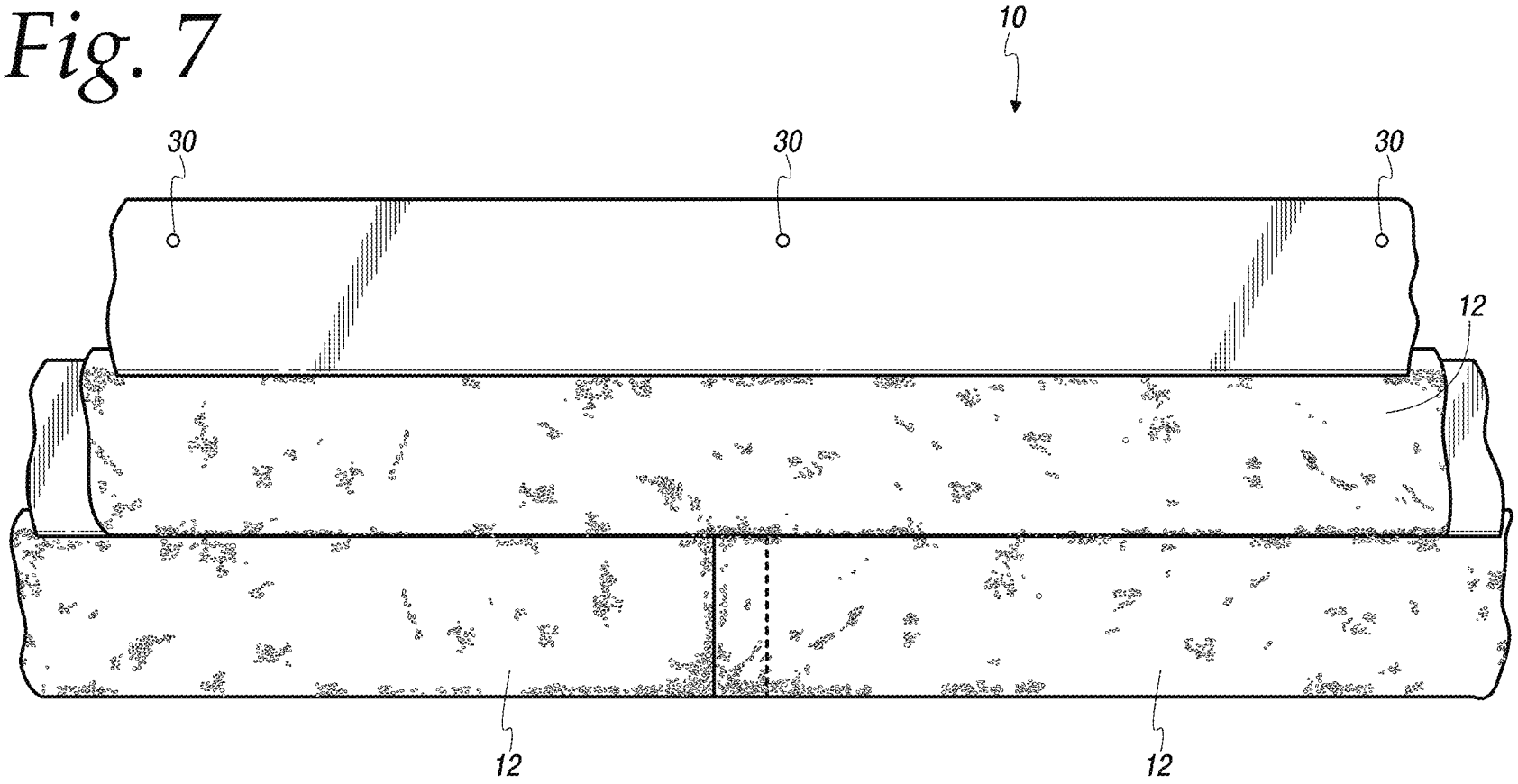
FIG. 7 is a top plan view of two roofing shingles of FIG. 1 abutted together side-by-side in a first course and a third roofing shingle of FIG. 1 connected thereto in a second course.

As best shown in FIG. 7, the lower groove 26 is configured to receive at least a portion of a tongue 18 of a second shingle 12, and the upper groove 20 is configured to receive at least a portion of a return 24 of a third shingle 12. Apertures 30 may be provided in the upper portion 14 of the shingle 12 in some embodiments for receiving nails or screws or other fasteners that may be used to secure the shingle 12 to a sub-roof, for example, plywood sheathing (not shown).

Figure 5:
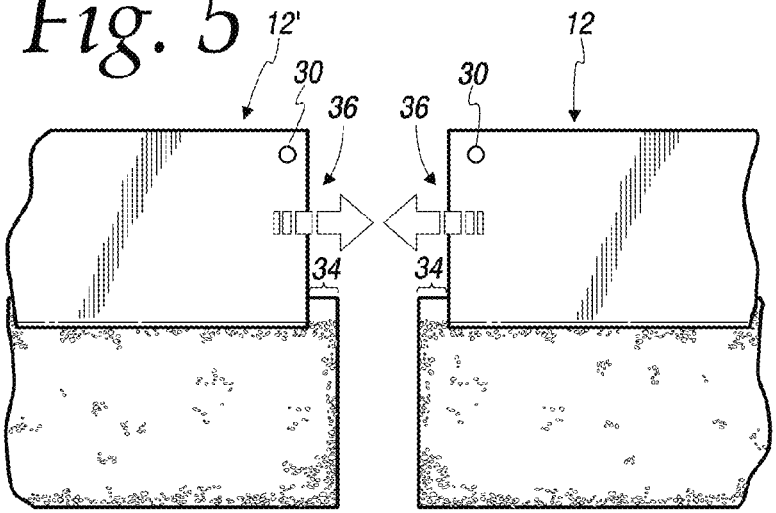
FIG. 5 is a top plan view of two roofing shingles of FIG. 1 side-by-side and prior to abutment together thereof.
Figure 6:
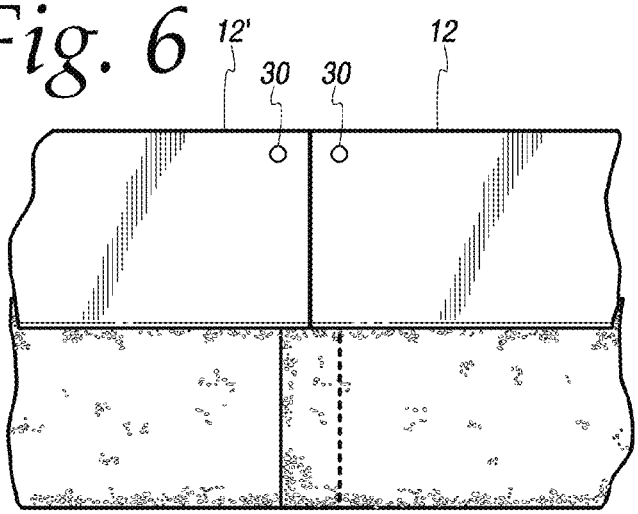
FIG. 6 is a top plan view of two roofing shingles of FIG. 1 abutted together side-by-side.

The lower portion 16 is wider than the upper portion 14 and the tongue 18. As such, the lower portion 16 defines outwardly extending tabs 34 at both ends of the shingle 12. Conversely, the upper portion 14 defines inwardly extending notches 36 at both ends of the shingle 12. This configuration allows for assembling a first course of shingles by inserting the bottom end of a second shingle 12' into the lower groove 26 of a first shingle 12 such that a tab 34 of the first shingle 12 overlaps an adjacent tab 34 of the second shingle 12', and such that upper portions 14 of the first shingle 12 and the second shingle 12' generally abut. An upper portion of the tab 34 of the first shingle 12 is received by the upper groove 20 of the second shingle 12'. FIGS. 5 and 6, respectively, show the first and second shingles 12, 12' prior to and after such assembly.

A second course of shingles 12 can be assembled to the first course of shingles by placing a first shingle 12 of the second course over the first and second shingles 12 of the first course so that the first shingle of the second course overlaps the abutting ends of the first and second shingles of the first course. A third course of shingles 12 may be assembled to the second course of shingles in a similar manner. The resultant structure is best shown in FIG. 7.

In an embodiment, the shingle 12 may be made of sheet metal, for example, sheet steel or aluminum, and may be bent to the illustrated form using any suitable process. For example, a blank could be formed by cutting a piece of sheet metal to a desired size, cutting or punching the blank to form the notches 36, punching or drilling the optional apertures 30, and bending the blank to the illustrated form or another suitable form using, for example, a sheet metal brake or a roll forming process. In another embodiment, the shingle 12 could be molded from a plastic or other moldable material. In a further embodiment, the shingle 12 could be made of a fiber-reinforced plastic. The shingle 12 could be made in other ways, as well.

The overall dimensions of the shingle 12 may be, but need not be, similar to the overall dimensions of a conventional asphalt shingle.

In an embodiment, the lower portion 16 may be coated with roofing granules 32, for example, stone chips or the like. The granules 26 may be adhered to the shingle 12 using an adhesive (not shown). The granules 26 may be colored and/or textured to provide the shingle 12 with an appearance similar to conventional asphalt shingle.

In an embodiment, the upper portion 14 of the shingle 12 could include a first section 14A and a second section 14B. The first section 14A could extend sufficiently upwardly from the tongue 18 to provide a landing area for receiving an adhesive 38 for joining the second section 14B to the first section 14A. In an embodiment, the second section 14B could be made of any suitable roofing membrane. For example, the second section 14B could be embodies as an asphalt roofing membrane, a rubber roofing membrane, a peel-and-stick ice and water shield, another form of roofing membrane. Such roofing membranes typically preclude water infiltration there through. Alternatively, the second section 14B could be embodied as any other suitable moisture barrier or other non-metal substrate. In either of the foregoing embodiments, the shingle 12 may be attached to a sub-roof by driving nails or screws or other fasteners through the second section 14B. The second section 14B may be self-sealing against such fasteners. That is, it may conform and adhere to such fasteners driven there through to control or preclude moisture infiltration through the openings receiving the fasteners.

The invention claimed is:

1. A method of attaching roofing shingles to a roof of a structure, comprising the steps of:

providing a first shingle and a second shingle, each of said first and second shingles comprising:

a first portion having a first surface, an opposing second surface, a free end, and a second end;

a second portion having a first surface, an opposing second surface, a free end, and a second end, said second end of said second portion adjacent said second end of said first portion;

a tongue extending from said first portion opposite said free end and overlying at least part of said first surface of said second portion, said tongue and said second portion cooperating to define a first groove there between; and a third portion extending from said free end of second portion, said third portion overlying at least part of said second surface of said second portion, said third portion and said second portion cooperating to define a second groove there between;

said first portion further having a first width and said second portion having a second width, said second width greater than said first width, whereby said second portion defines a first tab extending beyond a first end of said first portion and a second tab extending beyond a second end of said first portion, each of said first portion, said second portion, and said third portion are formed of sheet metal;

engaging said first tab of said second shingle within said first groove of said first shingle; and engaging said second tab of said first shingle with said second groove of said second shingle;

fastening said first shingle to said roof; and fastening said second shingle to said roof.

2. The method of claim 1 wherein said second portion of said first shingle comprises a metal material.

3. The method of claim 2 wherein said first portion of said first shingle comprises a metal material.

4. The method of claim 3 wherein said first portion of said first shingle defines an aperture, and wherein said step of fastening said first shingle to said roof comprises inserting a fastener through said aperture and fastening said fastener to said roof.

5. The method of claim 3 wherein said first portion of said first shingle includes a first section extending from said second portion and a second section extending from said first section, said first section comprising a metal material and said second section comprising a roofing membrane, the method further comprising driving a fastener through said roofing membrane into said roof.

6. The method of claim 5 wherein said roofing membrane comprises an asphalt roofing membrane, a rubber roofing membrane, or a peel-and-stick ice and water shield.

7. The method of claim 5 further comprising the steps of:

providing a third shingle, said third shingle comprising:

a first portion having a first surface, an opposing second surface, a free end, and a second end;

a second portion having a first surface, an opposing second surface, a free end, and a second end, said second end of said second portion adjacent said second end of said first portion;

a tongue extending from said first portion opposite said free end and overlying at least part of said first surface of said second portion, said tongue and said second portion cooperating to define a first groove there between; and a third portion extending from said free end of said second portion, said third portion overlying at least part of said second surface of said second portion, said third portion and said second portion cooperating to define a second groove there between;

inserting said tongue of said first shingle and said tongue of said second single into said second groove of said third shingle; and fastening said third shingle to said roof.

8. A roofing system comprising:

a first shingle and a second shingle, each of said first and second shingles comprising:

a first portion having a first surface, an opposing second surface, a free end, and a second end;

a second portion having a first surface, an opposing second surface, a free end, and a second end, said second end of said second portion adjacent said second end of said first portion;

a tongue extending from said first portion opposite said free end of said first portion and overlying at least part of said first surface of said second portion, said tongue and said second portion cooperating to define a first groove there between; and a third portion extending from said free end of said second portion, said third portion overlying said second surface of said second portion, said third portion and said second portion cooperating to define a second groove there between;

said first portion further having a first width and said second portion having a second width, said second width greater than said first width, whereby said second portion defines a first tab extending beyond a first end of said first portion and a second tab extending beyond a second end of said first portion, each of said first portion, said second portion, and said third portion are formed of sheet metal;

said first tab of said second shingle engaged within said first groove of said first shingle; and said second tab of said first shingle engaged with said second groove of said second shingle.

9. The system of claim 8 further comprising:

a third shingle comprising:

a first portion having a first surface, an opposing second surface, a free end, and a second end;

a second portion having a first surface, an opposing second surface, a free end, and a second end, said second end of said second portion adjacent said second end of said first portion;

a tongue extending from said first portion opposite said free end of said first portion and overlying at least part of said first surface of said second portion, said tongue and said second portion cooperating to define a first groove there between; and a third portion extending from said free end of said second portion, said third portion overlying at least part of said second surface of said second portion, said third portion and said second portion cooperating to define a second groove there between;

said third shingle overlying part of said upper portion of said first shingle and part of said upper portion of said second shingle, said tongue of said first shingle and said tongue of said second shingle at least partially received within said second groove of said third shingle.

10. The system of claim 8 further comprising roofing granules coating at least a portion of said first surface of said second portion of said first shingle.

11. The system of claim 8 wherein said second portion of said first shingle comprises a metal material.

12. The shingle of claim 11 wherein said first portion of said first shingle comprises a metal material.

13. The shingle of claim 12 wherein said first portion of said first shingle defines at least one aperture.

14. The shingle of claim 11 wherein said first portion of said first shingle includes a first section extending from said second portion and a second section extending from said first section, said first section comprising a metal material and said second section comprising a roofing membrane.

15. The shingle of claim 14 wherein said roofing membrane comprises an asphalt roofing membrane, a rubber roofing membrane, or a peel-and-stick ice and water shield.

* * * * *